US010131164B2

(12) United States Patent
Hara

(10) Patent No.: US 10,131,164 B2
(45) Date of Patent: Nov. 20, 2018

(54) PRINTER WITH DIFFERENT CONVEYANCE SPEEDS OF RECORDING MEDIUM

(71) Applicant: RISO KAGAKU CORPORATION, Tokyo (JP)

(72) Inventor: Masashi Hara, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/666,898

(22) Filed: Aug. 2, 2017

(65) Prior Publication Data

US 2018/0056677 A1 Mar. 1, 2018

(30) Foreign Application Priority Data

Aug. 30, 2016 (JP) ..... 2016-167809

(51) Int. Cl.

| | |
|---|---|
| ***B41J 13/00*** | (2006.01) |
| ***B41J 11/42*** | (2006.01) |
| ***B41J 3/60*** | (2006.01) |
| *B41J 11/00* | (2006.01) |
| *B41J 13/02* | (2006.01) |

(52) U.S. Cl.

CPC ..... *B41J 13/0009* (2013.01); *B41J 3/60* (2013.01); *B41J 11/42* (2013.01); *B41J 11/425* (2013.01); *B41J 11/007* (2013.01); *B41J 13/02* (2013.01); *G03G 2215/00556* (2013.01)

(58) Field of Classification Search

CPC ..... B41J 13/0009; B41J 11/42; B41J 13/02; B41J 11/007; B41J 11/425; B41J 3/60; G03G 2215/00556

See application file for complete search history.

(56) References Cited

U.S. PATENT DOCUMENTS

| | | | |
|---|---|---|---|
| 8,121,510 | B2 | 2/2012 | Roppongi |
| 8,503,922 | B2 | 8/2013 | Maeda et al. |
| 9,665,812 | B2 | 5/2017 | Hara |

(Continued)

FOREIGN PATENT DOCUMENTS

| | | | |
|---|---|---|---|
| JP | 2009-46303 | A | 3/2009 |
| WO | 2009/014033 | A1 | 1/2009 |

OTHER PUBLICATIONS

Search Report issued in European Patent Office (EPO) family member Patent Appl. No. 17185077.9, dated Jan. 4, 2018.

*Primary Examiner* — Yaovi M Ameh

(74) *Attorney, Agent, or Firm* — Greenblum & Bernstein, P.L.C.

(57) ABSTRACT

A printer includes: a first conveyor configured to convey a recording medium during image formation by an image former at a first conveyance speed based on a print condition of the image formation by the image former; a second conveyor configured to convey the recording medium at a second conveyance speed higher than the first conveyance speed; and a third conveyor arranged between the first conveyor and the second conveyor on a conveyance route. The third conveyor is configured to start acceleration of the recording medium after a recording region trailing end of the recording medium passes the image former and accelerate the recording medium such that a speed of the recording medium increases to the second conveyance speed not later than a time point when a leading edge of the recording medium reaches the second conveyor.

8 Claims, 6 Drawing Sheets

(56) References Cited

U.S. PATENT DOCUMENTS

| | | | | |
|---|---|---|---|---|
| 9,782,989 | B2 | 10/2017 | Nishiyama | |
| 2009/0184466 | A1* | 7/2009 | Maeda | B65H 29/125 271/314 |
| 2011/0094684 | A1* | 4/2011 | Ohsawa | B41F 7/06 156/367 |
| 2016/0152053 | A1 | 6/2016 | Oe | |
| 2016/0185542 | A1 | 6/2016 | Inoue et al. | |
| 2016/0274525 | A1 | 9/2016 | Hara | |
| 2017/0253053 | A1 | 9/2017 | Shinohara et al. | |

* cited by examiner

PRINTER WITH DIFFERENT CONVEYANCE SPEEDS OF RECORDING MEDIUM

CROSS REFERENCE TO RELATED APPLICATION

This application is based upon and claims the benefit of priority from the prior Japanese Patent Application No. 2016-167809, filed on Aug. 30, 2016, the entire contents of which are incorporated herein by reference.

BACKGROUND

1. Technical Field

The disclosure relates to a printer.

2. Related Art

There is a printer which performs a print operation based on a print job. The print operation includes feeding a sheet from a sheet feed tray, performing printing on the fed sheet with a printing unit while conveying the sheet with a conveyor belt, based on a print job, then conveying the sheet with multiple conveyance rollers, and finally discharging the sheet to a sheet receiving tray with sheet discharge rollers.

In this operation, a conveyance speed of the sheet by the conveyor belt is determined depending on a print speed. The conveyance speed of the sheet conveyed by the sheet discharge rollers is determined by a sheet discharge speed of discharging the sheet to the sheet receiving tray. Generally, the conveyance speed of the sheet conveyed by the sheet discharge rollers is higher than the conveyance speed of the sheet by the conveyor belt.

Accordingly, out of the multiple conveyance rollers, upstream conveyance rollers (close to the conveyer belt) operate at the conveyance speed equal to that of the conveyor belt, and downstream conveyance rollers (close to the sheet discharge rollers) operate at the conveyance speed equal to that of the sheet discharge rollers, that is, higher than that of the conveyor belt.

Due to this, when the conveyed sheet reaches the downstream conveyance rollers, the sheet conveyed by the upstream conveyance rollers is pulled out by the downstream conveyance rollers.

When the sheet is pulled out by the downstream conveyance rollers as described above, slipping occurs in the upstream conveyance rollers and this slipping may lead to a degradation in print quality due to retransfer of inks to the sheet or conveyance failure caused by wear of the upstream conveyance rollers.

Japanese Unexamined Patent Application Publication No. 2009-46303 describes a duplex printer which includes a sheet conveyance route including a constant speed section L1 where a sheet is conveyed at a conveyance speed Vg, and a constant speed section L2 where the sheet is conveyed at a circulation conveyance speed Vr higher than the conveyance speed Vg.

SUMMARY

Since the duplex printer described in Japanese Unexamined Patent Application Publication No. 2009-46303 conveys the sheet at the conveyance speed Vg in the constant speed section L1 and conveys the sheet at the circulation conveyance speed Vr higher than the conveyance speed Vg in the constant speed section L2 in the sheet conveyance route, the sheet is pulled out at the start of the conveyance of the sheet at the circulation conveyance speed Vr.

Accordingly, the slipping of the conveyance rollers occurs and this slipping may lead to the degradation in print quality due to the retransfer of the inks to the sheet or the conveyance failure caused by the wear of the upstream conveyance rollers.

An object of the disclosure is to provide a printer with improved print quality.

A printer in accordance with some embodiments includes: a conveyance route; an image former configured to form an image on a recording medium being conveyed along the conveyance route; a first conveyor configured to convey the recording medium during image formation by the image former along the conveyance route at a first conveyance speed based on a print condition of the image formation by the image former; a second conveyor configured to convey the recording medium along the conveyance route at a second conveyance speed higher than the first conveyance speed; a third conveyor arranged between the first conveyor and the second conveyor on the conveyance route and configured to convey the recording medium along the conveyance route, the third conveyor being configured to start acceleration of the recording medium after a recording region trailing end of the recording medium passes the image former and accelerate the recording medium such that a speed of the recording medium increases to the second conveyance speed not later than a time point when a leading edge of the recording medium reaches the second conveyor; and a drive controller configured to control a timing at which the third conveyor starts the acceleration.

In the aforementioned configuration, since the third conveyor is controlled to convey the recording medium while increasing the conveyance speed from the first conveyance speed to the second conveyance speed, the recording medium is already conveyed at the second conveyance speed when reaching the second conveyor. Accordingly, no pull-out of the recording medium by the second conveyor occurs.

This can prevent slipping in the third conveyor and prevent a degradation in print quality due to retransfer of inks to the sheet caused by this slipping and conveyance failure caused by wear of the third conveyor. Moreover, when the timing of starting the acceleration by the third conveyor is controlled depending on the size of the recording medium, the following can be achieved. When there are multiple sizes of print media to be printed, the recording media can be stably conveyed depending on their sizes. For example, the shorter the size of the recording medium in the conveyance direction is, the shorter the time it takes for the recording medium to pass a section conveyed at the first conveyance speed. Accordingly, the conveyance speed can be increased from the first conveyance speed to the second conveyance speed at an earlier timing. As a result, the shorter the size of the recording medium in the conveyance direction is, the more stable the conveyance of the recording medium can be.

The printer may further include a detector arranged between the first conveyor and the third conveyor on the conveyance route and configured to detect the recording medium being conveyed. The third conveyor may include: a first acceleration conveyance driver; a second acceleration conveyance driver located downstream of the first acceleration conveyance driver on the conveyance route; and a third acceleration conveyance driver located downstream of the second acceleration conveyance driver on the conveyance route. The drive controller may be configured to: for the recording medium of a size in a conveyance direction being equal to or shorter than a first length of the conveyance route from a downstream drive end position of the first conveyor to the second acceleration conveyance driver, drive the first acceleration conveyance driver to start the acceleration of the recording medium upon determining that the recording medium has passed the downstream drive end position of the first conveyor based on a detection result of the detector and to accelerate the recording medium to the second conveyance speed; for the recording medium of the size in the conveyance direction being longer than the first length and equal to or shorter than a second length of the conveyance route from the downstream drive end position of the first conveyor to the third acceleration conveyance driver, drive the first acceleration conveyance driver and the second acceleration conveyance driver to start the acceleration of the recording medium upon determining that the recording medium has passed the downstream drive end position of the first conveyor based on the detection result of the detector and to accelerate the recording medium to the second conveyance speed; and for the recording medium of the size in the conveyance direction being longer than the second length and equal to or shorter than a third length of the conveyance route from the downstream drive end position of the first conveyor to the second conveyor, drive the first acceleration conveyance driver, the second acceleration conveyance driver, and the third acceleration conveyance driver to start the acceleration of the recording medium upon determining that the recording medium has passed the downstream drive end position of the first conveyor based on the detection result of the detector and to accelerate the recording medium to the second conveyance speed.

In the aforementioned configuration, since no pull-out of the recording medium conveyed by the first conveyor occurs, no slipping occurs in the first conveyor. Hence it is possible to prevent the degradation in print quality due to the retransfer of the inks to the recording medium and the conveyance failure caused by the wear of the belt.

The printer may further include a detector arranged between the first conveyor and the third conveyor on the conveyance route and configured to detect the conveyed recording medium. The third conveyor may include: a first acceleration conveyance driver; a second acceleration conveyance driver located downstream of the first acceleration conveyance driver on the conveyance route; and a third acceleration conveyance driver located downstream of the second acceleration conveyance driver on the conveyance route. The drive controller may be configured to: for the recording medium of a size in a conveyance direction being equal to or shorter than a fourth length of the conveyance route from a downstream end of the image former to the second acceleration conveyance driver, drive the first acceleration conveyance driver to start the acceleration of the recording medium upon determining that the recording medium has passed the downstream end of the image former based on a detection result of the detector and to accelerate the recording medium to the second conveyance speed; for the recording medium of the size in the conveyance direction being longer than the fourth length and equal to or shorter than a fifth length of the conveyance route from the downstream end of the image former to the third acceleration conveyance driver, drive the first acceleration conveyance driver and the second acceleration conveyance driver to start the acceleration of the recording medium upon determining that the recording medium has passed the downstream end of the image former based on the detection result of the detector and to accelerate the recording medium to the second conveyance speed; and for the recording medium of the size in the conveyance direction being longer than the fifth length and equal to or shorter than a sixth length of the conveyance route from the downstream end of the image former to the second conveyor, drive the first acceleration conveyance driver, the second acceleration conveyance driver, and the third acceleration conveyance driver to start the acceleration of the recording medium upon determining that the recording medium has passed the downstream end of the image former based on the detection result of the detector and to accelerate the recording medium to the second conveyance speed.

In the aforementioned configuration, since the acceleration of the recording medium is started when the recording medium moves past the image former, the recording medium can reach the second conveyance speed sooner. Accordingly, the productivity can be improved The first conveyor may include a conveyor belt, the second conveyor may include at least one of a roller or a conveyor belt, and the third conveyor may include at least one of a roller or a conveyor belt.

DETAILED DESCRIPTION

Figure 1:
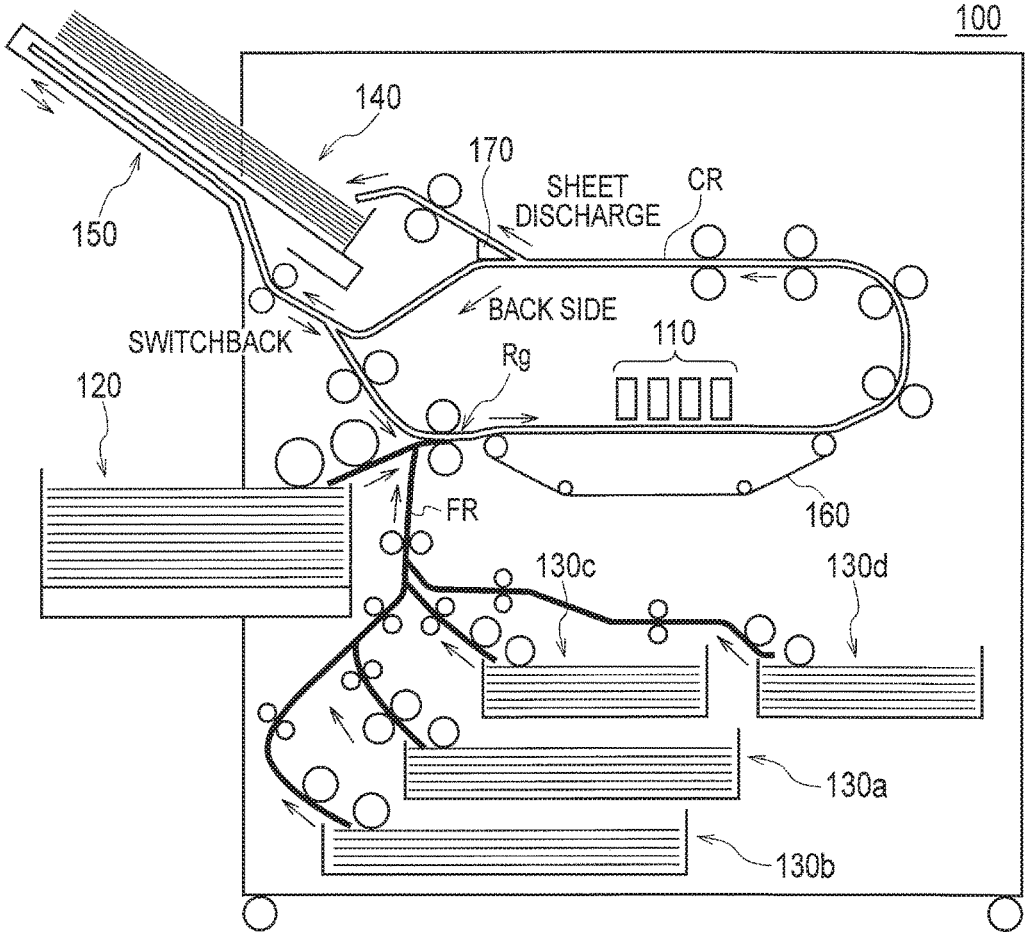
FIG. 1 is a diagram schematically illustrating a print sheet conveyance route of a printer in an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Configuration of Printer

FIG. 1 is a view illustrating an outline of a print sheet conveyance route in a printer 100 in an embodiment of the present invention, the printer 100 including a circulation system conveyance route CR. As illustrated in FIG. 1, the printer 100 includes a side sheet feed tray 120 exposed to the outside on a side surface of a housing and multiple sheet feed trays (130*a*, 130*b*, 130*c*, 130*d*) arranged inside the housing, as sheet feed mechanisms configured to feed recording media such as print sheets. Moreover, the printer 100 includes a sheet discharge opening 140 as a sheet discharge mechanism configured to discharge the print sheets subjected to printing. Note that the material of the print sheets is not limited to paper and may be other materials such as a synthetic resin.

The printer 100 is a line color printer of an inkjet method which performs printing in units of lines. The line color printer of the inkjet method includes, as a print mechanism, multiple print heads which extend in a direction orthogonal to a sheet conveyance direction and in which many nozzles are formed, and performs printing by ejecting black and color inks from the print heads. However, the present invention is not limited to this method and can be applied to a printer of a different print method. For example, the invention can be applied to a printer of a serial inkjet method, a laser method, or the like. Moreover, the present invention can be applied to a printer which performs not only printing based on print data sent from a host computer but also other types of print processing such as duplication printing and facsimile printing.

The print sheets fed one by one from one of the sheet feed mechanisms of the side sheet feed tray 120 and the sheet feed trays 130 are conveyed by drive mechanisms such as rollers, along a sheet feed system conveyance route FR in the housing to be guided to a registration unit Rg. The registration unit Rg is provided to align a leading edge of each print sheet and perform skew correction of the print sheet, and includes a pair of registration rollers. The fed print sheet is temporarily stopped at the registration unit Rg and is conveyed in a direction toward the print mechanism at a certain timing.

A head unit 110 in which the multiple print heads are incorporated is arranged downstream of the registration unit Rg in the conveyance direction. The fed print sheet is vacuum-sucked by an annular conveyor belt 160 arranged in a surface opposite to the head unit 110, and is subjected to image formation in units of lines by using the inks ejected from the print heads of the head unit 110 while being conveyed at a speed determined depending on print conditions.

The print sheet subjected to printing is further conveyed inside the housing by drive mechanisms such as rollers. In simplex printing in which printing is performed only one side of the print sheet, the print sheet is directly guided to the sheet discharge opening 140 to be discharged and is stacked on a sheet receiving tray 150 provided as a receiving tray for the sheet discharge opening 140, with the side subjected to the printing facing downward. The sheet receiving tray 150 has a tray shape protruding from the housing and is thick to some extent. The sheet receiving tray 150 is tilted and is configured such that the print sheets discharged from the sheet discharge opening 140 and sliding down along the tilt are stacked while being aligned automatically by a wall formed at a low position of the tilt.

In duplex printing in which printing is performed on both sides of the print sheet, the print sheet is not guided to the sheet discharge opening 140 when the printing on the front side (hereafter, the side printed first is referred to as "front side" and the side printed next is referred to as "back side") is completed, but instead further conveyed inside the housing. The printer 100 thus includes a switching mechanism (flipper) 170 configured to perform switching to a conveyance route for back side printing. The print sheet prevented from being discharged by the switching mechanism 170 is made to enter a switchback route SR and is switched back to be turned over with respect to the conveyance route. Then, the print sheet is guided to the registration unit Rg again by drive mechanisms such as rollers and temporarily stopped. Thereafter, the print sheet is conveyed in the direction toward the print mechanism at a certain timing and printing on the back side is performed in the same manner as that for the front side. The print sheet subjected to printing on the back side and having images formed on both sides is guided to the sheet discharge opening 140 to be discharged and is stacked on the sheet receiving tray 150 provided as the receiving tray for the sheet discharge opening 140.

In the printer 100, the switchback in the duplex printing is performed by utilizing a space provided inside the sheet receiving tray 150. The space provided inside the sheet receiving tray 150 is configured such that the sheet receiving tray 150 covers the print sheet to prevent take out of the print sheet from the outside during the switchback. This can prevent the case where a user accidentally pulls out the print sheet during the switchback operation. Moreover, since the sheet receiving tray 150 is essentially included in the printer 100, utilizing the space inside the sheet receiving tray 150 to perform the switchback eliminates the need to provide an additional space for the switchback in the printer 100. Accordingly, an increase in the size of the housing can be prevented. Furthermore, since the sheet discharge opening and the switchback route are separate from each other, the switchback processing and discharging of the other print sheets can be performed in parallel.

In the printer 100, the print sheet printed on one side in the duplex printing is also conveyed to the registration unit Rg which is a reference position of a leading edge portion of the fed print sheet. Thus, in a portion just before the registration unit Rg, there is a merging point where the conveyance route for the fed print sheet merges with the route along which the sheet to be printed on the back side is circulated and conveyed. The route on the sheet feed mechanism side of the merging point is referred to as sheet feed system conveyance route FR and other routes are referred to as circulation system conveyance route CR. Note that the switchback route SR is assumed to be part of the circulation system conveyance route CR.

Figure 2:
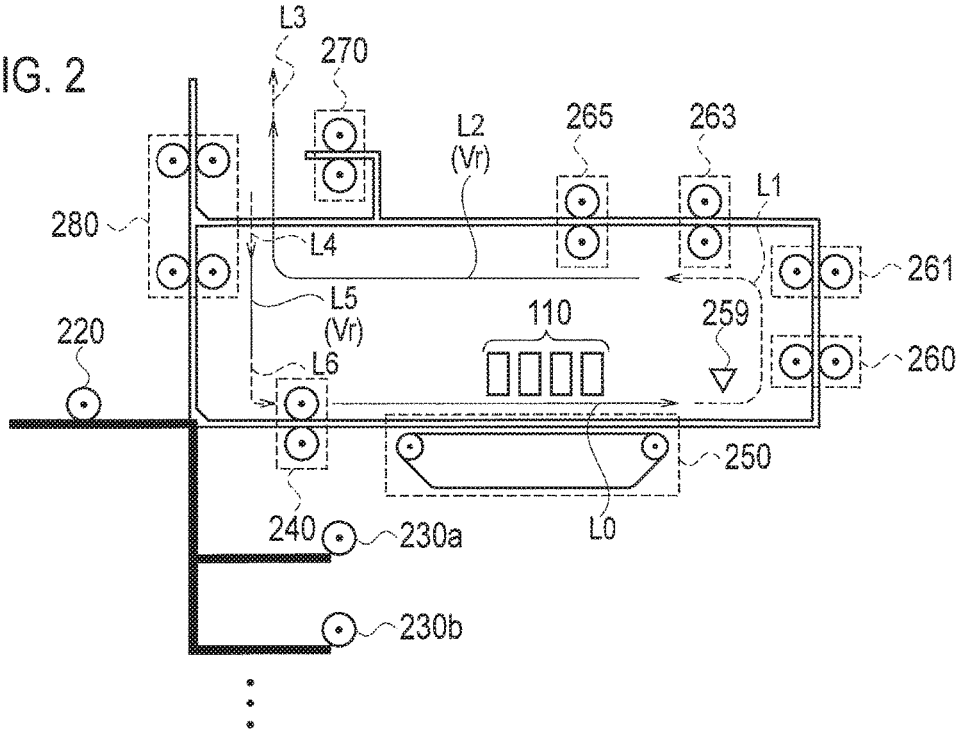
FIG. 2 is a diagram schematically illustrating a sheet feed system conveyance route and a circulation system conveyance route of the printer in the embodiment of the present invention.

FIG. 2 is a view schematically illustrating the sheet feed system conveyance route FR and the circulation system conveyance route CR. Some of rollers forming drivers are omitted as appropriate for simplification. The sheet feed system conveyance route FR is provided with a side sheet feed driver 220 which feeds the sheets from the side sheet feed tray 120 and a tray 1 driver 230*a*, a tray 2 driver 230*b*, . . . which feed the sheets from the sheet feed trays (130*a*, 130*b*, 130*c*, 130*d*). Each of the drivers includes a drive mechanism including multiple rollers and the like, and picks up the print sheets stacked on the side sheet feed tray or the sheet feed tray one by one to convey the print sheets in the direction toward the registration unit Rg. The drivers can run independently and a necessary driver is operated depending on the sheet feed mechanism to perform sheet feeding.

The circulation system conveyance route CR is provided with: a registration driver 240 which includes the registration rollers; a belt driver 250 (first conveyor) which drives the conveyor belt 160 arranged in the surface opposite to the head unit 110; a first acceleration conveyance driver 260, a second acceleration conveyance driver 261, and a third acceleration conveyance driver 263 which are arranged in this order in the conveyance direction and which accelerate and convey the print sheet depending on its size; a constant speed conveyance driver 265 (second conveyor) which conveys the print sheet at a constant speed; a sheet discharge conveyance driver 270 which guides the sheet subjected to printing to the sheet discharge opening 140; and a switchback route driver 280 which pulls the print sheet into the switchback route SR, turns over the print sheet, and guides the print sheet to the merging point for back side printing. The drivers can run independently, and necessary drivers are operated depending on a conveyance situation of the print sheet. The first acceleration conveyance driver 260, the second acceleration conveyance driver 261, and the third acceleration conveyance driver 263 form an acceleration conveyor (third conveyor). As described above, the second acceleration conveyance driver 261 is located downstream of the first acceleration conveyance driver 260 in the circulation system conveyance route CR, and the third acceleration conveyance driver 263 is located downstream of the second acceleration conveyance driver 261 in the circulation system conveyance route CR. Moreover, in the embodiment, the first acceleration conveyance driver 260, the second acceleration conveyance driver 261, the third acceleration conveyance driver 263, and the constant speed conveyance driver 265 each includes at least one pair of rollers to convey the print sheet, but are not limited to this. For example, the first acceleration conveyance driver 260, the second acceleration conveyance driver 261, the third acceleration conveyance driver 263, and the constant speed conveyance driver 265 may each be one roller, a combination of rollers and a conveyor belt, only the conveyor belt, or any other drive mechanism capable of conveying the print sheet.

The printer 100 having fed a certain print sheet does not wait for the certain print sheet to be subjected to printing and discharged, before feeding the next print sheet. Instead, the printer 100 can feed the subsequent print sheet before the discharging of the preceding sheet and continuously perform printing at certain intervals.

Moreover, a sheet sensor 259 configured to detect the sheet is arranged between the belt driver 250 and the first acceleration conveyance driver 260 in the circulation system conveyance route CR. Note that, although not illustrated, in addition to the sheet sensor 259, a flipper sensor and multiple sheet sensors (sheet discharge sensor and the like) are arranged in the sheet feed system conveyance route FR and the circulation system conveyance route CR. These sensors detect presence or absence of a sheet at their arranged positions and can detect a sheet feed error, conveyance jam, a sheet discharge error, and the like.

Figure 3:
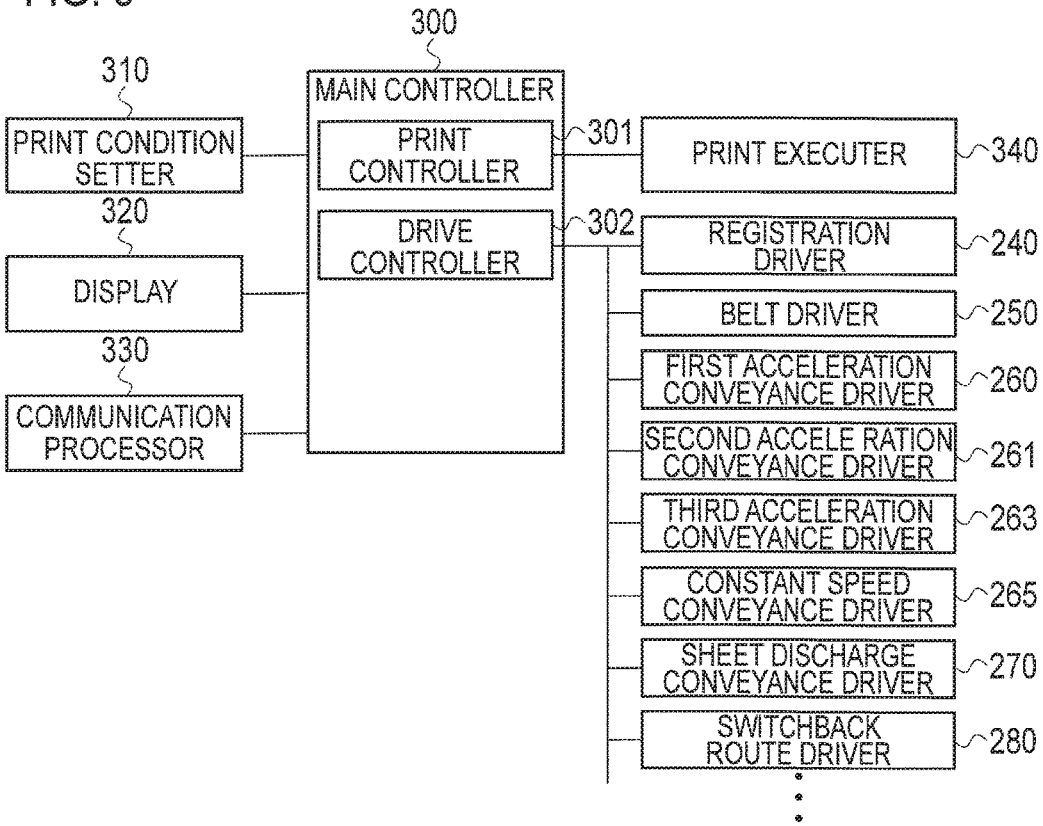
FIG. 3 is a block diagram illustrating a functional configuration of the printer in the embodiment of the embodiment of the present invention.

FIG. 3 is a block diagram illustrating a functional configuration of the printer 100. The printer 100 includes a main controller 300. The main controller 300 includes units such as a CPU, a RAM, a ROM, a hard disk, and a storage unit formed of a semiconductor memory or the like. The storage unit stores commands which, when executed by a processor such as the CPU, cause the processor to perform processing to be described later. A print controller 301 and a drive controller 302 are implemented by causing the CPU to operate according to a program (commands) stored in the storage unit or by performing similar operations.

The printer 100 includes a print condition setter 310 configured to receive settings of print conditions such as simplex or duplex printing, a sheet size, a resolution, and the like, a display 320 configured to display information on the printer, and a communication processor 330 configured to connect the printer to a computer network and the like. The print condition setter 310 receives, for example, print data sent from a computer connected to the printer via the computer network and the settings of print conditions inputted by the user giving instructions through a not-illustrated input panel. The print data includes information on a region of a sheet in which a recording is to be performed (recording region).

The print controller 301 generates image data according to the print conditions received in the print condition setter 310 and controls print processing in a print executor 340 including print mechanisms such as the print heads. The drive controller 302 operates the drivers described above under the control of the print controller 301 and conveys the print sheet.

Action of Printer

In the circulation system conveyance route CR, the print sheet is not always conveyed at a constant speed. As illustrated in FIG. 2, there are sections in which the print sheet is conveyed at a constant speed and sections in which the print sheet is accelerated and decelerated. Such a design is employed to prevent pull-out of the print sheet as described later. Note that, in FIG. 2, the arrows corresponding to the conveyance routes are illustrated based on the position of a leading edge of the print sheet in a traveling direction thereof.

In a section from a registration driver 240 to a downstream end of the belt driver 250, the speed needs to be maintained constant to perform image formation by ink ejection. Accordingly, the print sheet is conveyed at a constant speed of a print conveyance speed (first conveyance speed) Vg. The print conveyance speed Vg is a speed required to form an image by ink ejection from the head unit 110, and is determined from print conditions such as resolution and the maximum number of ink droplets for each pixel.

Accordingly, determining the print conditions uniquely determines the maximum value of the print conveyance speed Vg depending on the performance of the print mechanism of the printer 100, particularly ink ejection mechanisms of the print heads, the characteristics of the inks, and the like, irrespective of the simplex printing or the duplex printing. In the embodiment, in order for the print mechanism of the printer 100 to sufficiently deliver its performance, the print sheet is assumed to be conveyed at the highest speed achievable by the print mechanism and the conveyance speed in this case is referred to as print conveyance speed Vg. Note that the print conveyance speed Vg is not necessarily the highest speed physically achievable and may be the highest speed in an operation considering a certain margin or the like. As illustrated in FIG. 2 and the like, the section in which the print sheet is conveyed at the constant speed of the print conveyance speed Vg is referred to as constant speed section L0. The constant speed section L0 has a fixed length equal to a distance from the registration rollers of the registration driver 240 to the downstream of the belt driver 250.

In a section from the downstream of the belt driver 250 to the third acceleration conveyance driver 263, the print sheet is conveyed while being accelerated from the print conveyance speed Vg to a circulation conveyance speed (second conveyance speed) Vr based on the size of the print sheet in the conveyance direction. Specifically, the print sheet starts to be accelerated after a recording region trailing end of the print sheet passes the head unit 110 (in this case, when the print sheet passes a downstream drive end position of the belt driver 250), and is conveyed while being accelerated such that the speed thereof increases to the circulation conveyance speed Vr not later than when the leading edge of the print sheet reaches the constant speed conveyance driver 265. Note that "after a recording region trailing end of the print sheet passes the head unit 110" includes cases such as "after the trailing edge of the sheet in the conveyance direction passes," "after a position of a trailing edge portion of the print sheet in the conveyance direction excluding a required blank space passes," and "after all print processing in the print surface is completed." Moreover, the configuration is not limited to "after a recording region trailing end of the print sheet passes the head unit 110," and it is possible to replace the head unit 110 with the belt driver 250 and read "after a recording region trailing end of the print sheet passes the belt driver 250."

The circulation conveyance speed Vr is determined to be a speed equal to or higher than the print conveyance speed Vg, based on the timing of refeeding to the head unit 110. The section in which the print sheet is conveyed while being accelerated from the print conveyance speed Vg to the circulation conveyance speed Vr is referred to as acceleration section L1.

From the constant speed conveyance driver 265, the print sheet is conveyed at a constant speed of the circulation conveyance speed Vr determined by the processing to be described later. Here, the circulation conveyance speed Vr is set to be a speed equal to or higher than the print conveyance speed Vg to avoid collision between the print sheets in the circulation system conveyance route CR. The section in which the print sheet is conveyed at the constant speed of the circulation conveyance speed Vr is referred to as constant speed section L2. Since the print sheet is accelerated from the print conveyance speed Vg to the circulation conveyance speed Vr in the acceleration section L1, the print sheet is transferred to the constant speed section L2 without the pull-out of the print sheet occurring.

Thereafter, the print sheet is stopped to perform a switchback operation. In this case, if the print sheet is instantaneously stopped, the load on the switchback route driver 280 is large. The print sheet is thus decelerated from the circulation conveyance speed Vr to zero speed at a constant acceleration. This section is referred to as deceleration section L3. Note that the position where the print sheet is stopped varies depending on the size of the print sheet to avoid deviation of the end of the print sheet from the rollers. Accordingly, the length of the deceleration section L3 varies. Correspondingly, the length of the constant speed section L2 also varies.

Thereafter, the print sheet is accelerated from zero speed to the circulation conveyance speed Vr in an opposite direction. Since the traveling direction is reversed, the reference position of the print sheet is now the end opposite to the end being the reference position before the switchback. Also in this case, the print sheet is accelerated at a constant acceleration without the speed being changed instantaneously to avoid large load on the switchback route driver 280. This section is referred to as acceleration section L4.

When the print sheet is accelerated and reaches the circulation conveyance speed Vr, the print sheet is conveyed again at the constant speed of the circulation conveyance speed Vr. This section in which the print sheet is conveyed at the constant speed of the circulation conveyance speed Vr is referred to as constant speed section L5. Thereafter, the print sheet is decelerated from the circulation conveyance speed Vr to zero speed to stop the print sheet at the registration unit Rg. Also in this case, the print sheet is decelerated at a constant acceleration without being stopped instantaneously to prevent large load on the switchback route driver 280. This section is referred to as deceleration section L6.

In the embodiment, the same fixed value is used in the control of the accelerations in the respective acceleration and deceleration sections to avoid complicated processing. In other words, acceleration and deceleration is performed at the fixed acceleration. Hence, in the embodiment, the circulation conveyance speed Vr of the print sheet which can be easily adjusted is controlled to allow the print mechanism of the printer 100 to sufficiently deliver their performance also in the duplex printing. The processing load in the circulation conveyance is thereby reduced. Note that the acceleration may be changed depending on various conditions or the accelerations in the respective acceleration and deceleration sections may be varied.

Next, acceleration conveyance by the first acceleration conveyance driver 260, the second acceleration conveyance driver 261, and the third acceleration conveyance driver 263 is described in detail with reference to FIGS. 4A to 4C.

Figure 4A:
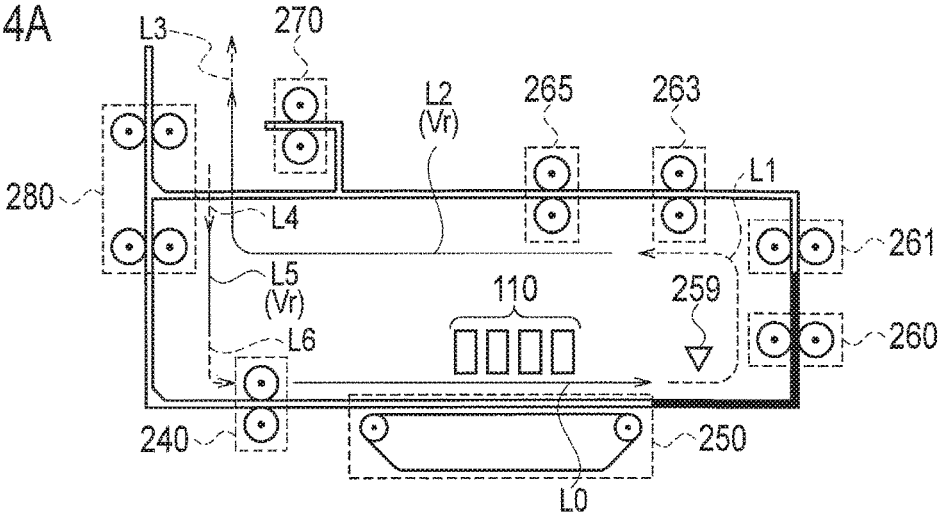
FIG. 4A is a diagram for explaining acceleration conveyance performed when a short-size print sheet is conveyed.
Figure 4B:
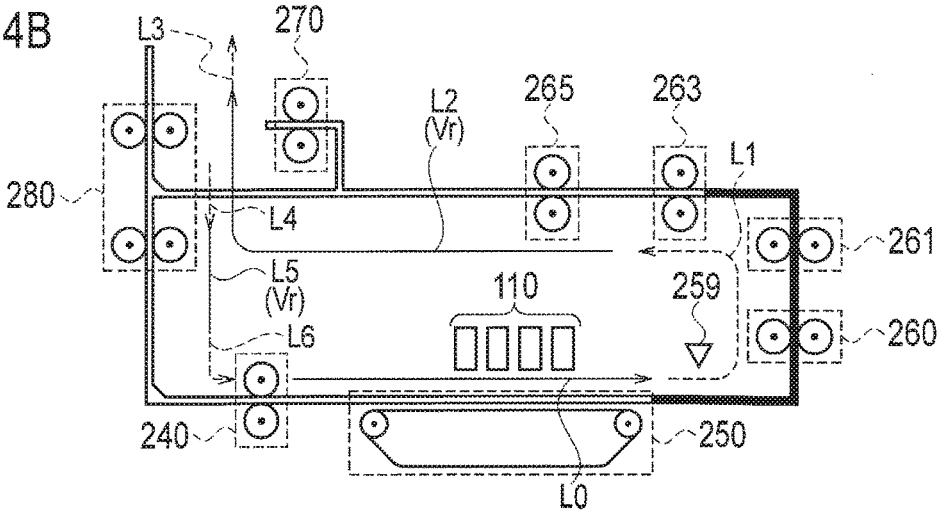
FIG. 4B is a diagram for explaining acceleration conveyance performed when a middle-size print sheet is conveyed.
Figure 4C:
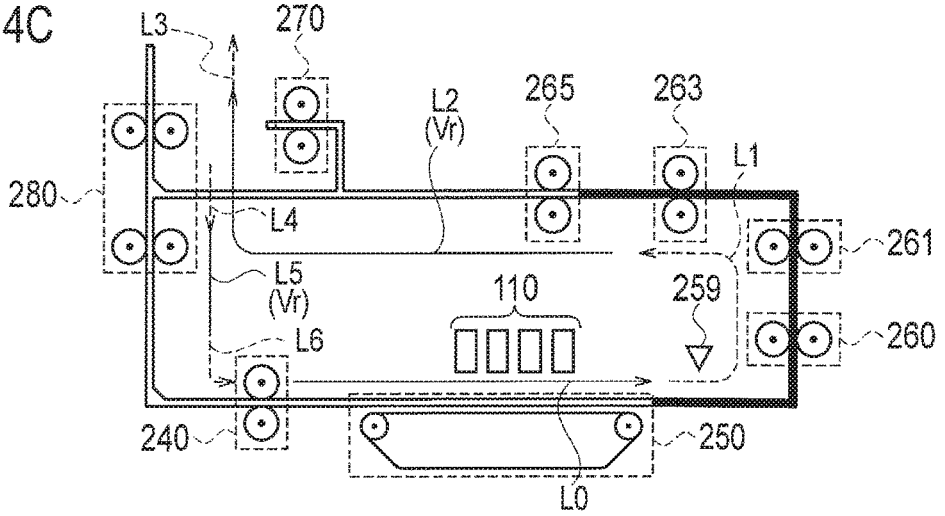
FIG. 4C is a diagram for explaining acceleration conveyance performed when a long-size print sheet is conveyed.

FIG. 4A is a diagram for explaining acceleration conveyance performed when a short-size print sheet is conveyed, FIG. 4B is a diagram for explaining acceleration conveyance performed when a middle-size print sheet is conveyed, and FIG. 4C is a diagram for explaining acceleration conveyance performed when a long-size print sheet is conveyed. Note that, in FIGS. 4A to 4C, black bold lines indicate the print sheets.

As illustrated in FIG. 4A, the sheet sensor 259 detects the leading edge of the print sheet having passed the constant speed section L0. Then, when the size of the print sheet obtained by the print condition setter 310 is the short size, that is, when the size of the print sheet in the conveyance route direction (conveyance direction) is equal to or shorter than a first length of the conveyance route from the downstream drive end position of the belt driver 250 to the second acceleration conveyance driver 261, the drive controller 302 starts the acceleration of only the first acceleration conveyance driver 260 out of the first acceleration conveyance driver 260, the second acceleration conveyance driver 261, and the third acceleration conveyance driver 263, upon determining that the print sheet has passed the downstream drive end position of the belt driver 250 based on the result of the print sheet detection by the sheet sensor 259, and accelerates the print sheet from the print conveyance speed Vg to the circulation conveyance speed Vr.

Figure 5:
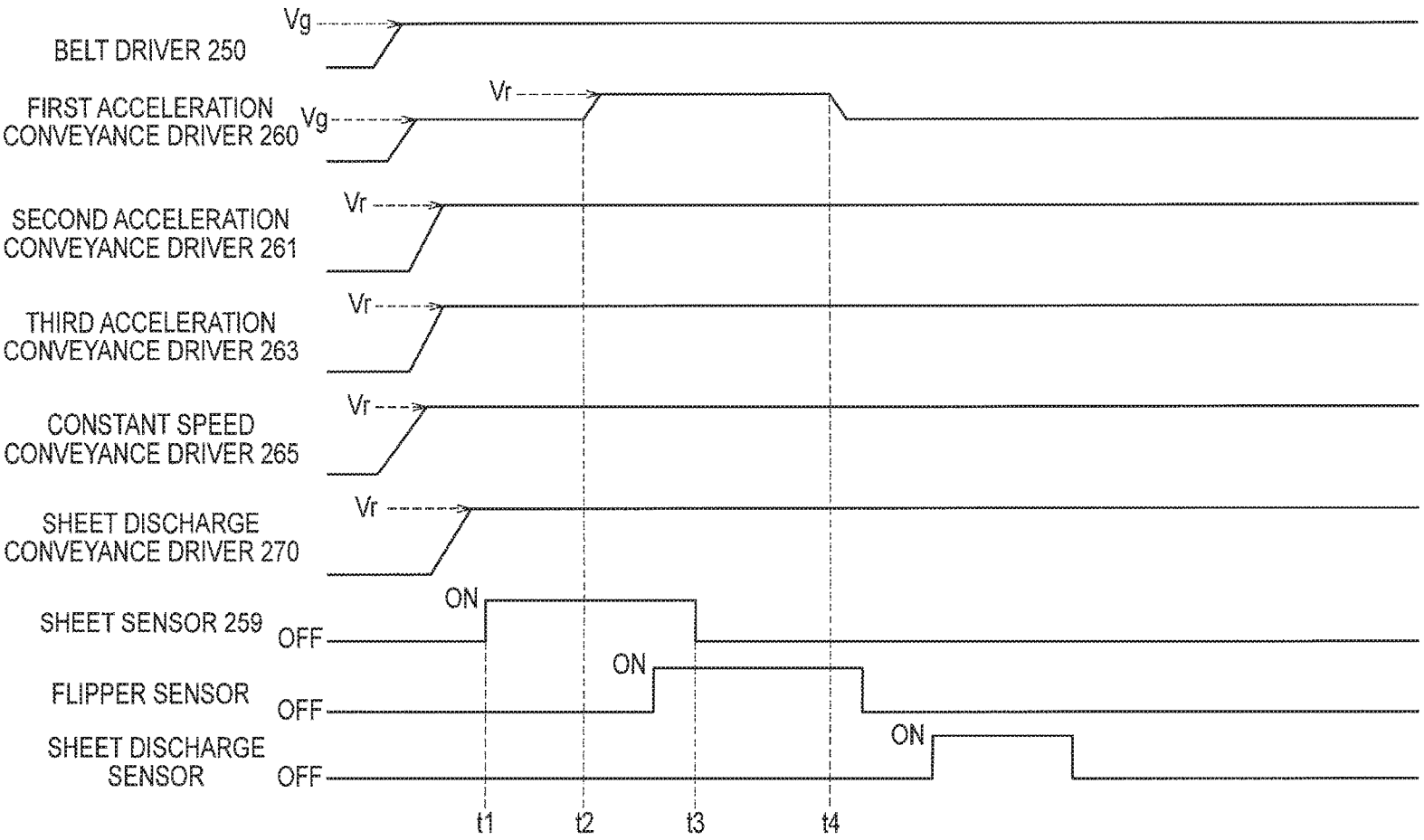
FIG. 5 is a timing chart illustrating timings in the acceleration conveyance performed when the short-size print sheet is conveyed.

FIG. 5 is a timing chart depicting timings in the acceleration conveyance performed when the short-size print sheet is conveyed.

As illustrated in FIG. 5, when the sheet sensor 259 detects the leading edge of the print sheet at a time point t1, the drive controller 302 estimates a time point t2 at which the print sheet passes the downstream drive end position of the belt driver 250, based on the print conveyance speed Vg and the size of the print sheet obtained by the print condition setter 310. Note that the speed of the first acceleration conveyance driver 260 is set to the print conveyance speed Vg before the time point t1. Moreover, the speeds of the second acceleration conveyance driver 261, the third acceleration conveyance driver 263, the constant speed conveyance driver 265, and the sheet discharge conveyance driver 270 (in the case of discharging the print sheet) are set to the circulation conveyance speed Vr before the time point t1.

Then, at the time point t2 at which the print sheet passes the downstream drive end position of the belt driver 250, the drive controller 302 starts the acceleration of the first acceleration conveyance driver 260 to accelerate the print sheet from the print conveyance speed Vg to the circulation conveyance speed Vr. Thus, no pull-out of the print sheet conveyed by the belt driver 250 occurs and therefore no slipping occurs. Moreover, the print sheet is already conveyed at the circulation conveyance speed Vr when reaching the constant speed conveyance driver 265. Accordingly, the pull-out of the print sheet by the constant speed conveyance driver 265 can be prevented. Hence, it is possible to prevent a degradation in print quality due to retransfer of the inks to the sheet and conveyance failure caused by wear of the belt.

Then, when the sheet sensor 259 detects the trailing edge of the print sheet at a time point t3, the drive controller 302 estimates a time point t4 at which the print sheet passes the first acceleration conveyance driver 260, based on the circulation conveyance speed Vr and the size of the print sheet obtained by the print condition setter 310.

Then, the drive controller 302 starts the deceleration of the first acceleration conveyance driver 260 at the time point t4 at which the print sheet passes the first acceleration conveyance driver 260.

Meanwhile, as illustrated in FIG. 4B, when the size of the print sheet obtained by the print condition setter 310 is the middle-size, that is, when the size of the print sheet in the conveyance route direction is longer than the first length and equal to or shorter than a second length of the conveyance route from the downstream drive end position of the belt driver 250 to the third acceleration conveyance driver 263, the drive controller 302 starts the acceleration of the first acceleration conveyance driver 260 and the second acceleration conveyance driver 261 out of the first acceleration conveyance driver 260, the second acceleration conveyance driver 261, and the third acceleration conveyance driver 263, upon determining that the print sheet has passed the downstream drive end position of the belt driver 250 based on the result of the print sheet detection by the sheet sensor 259, and accelerates the print sheet from the print conveyance speed Vg to the circulation conveyance speed Vr.

Figure 6:
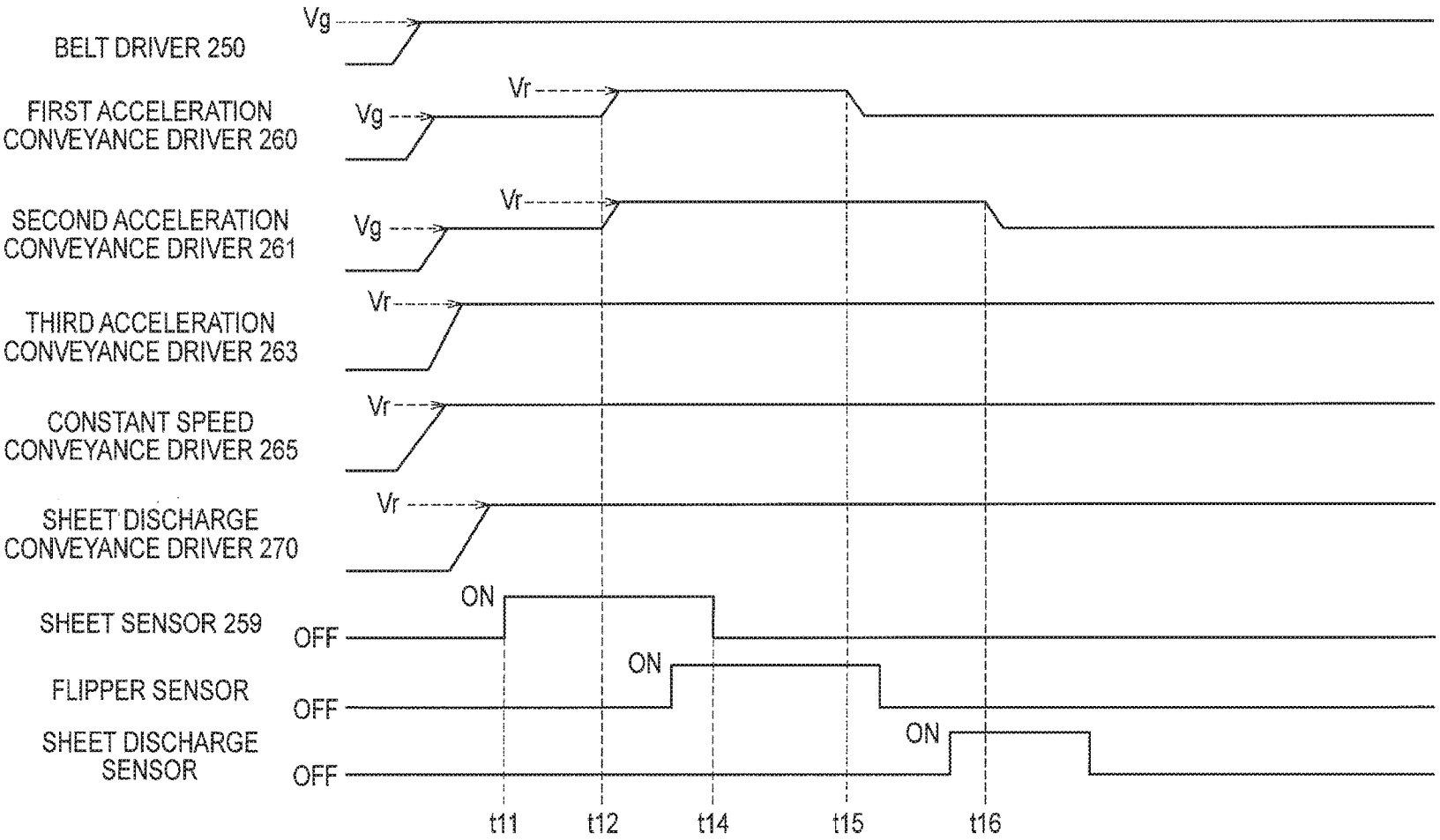
FIG. 6 is a timing chart illustrating timings in the acceleration conveyance performed when the middle-size print sheet is conveyed.

FIG. 6 is a timing chart depicting timings in the acceleration conveyance performed when the middle-size print sheet is conveyed.

As illustrated in FIG. 6, when the sheet sensor 259 detects the leading edge of the print sheet at a time point t11, the drive controller 302 estimates a time point t12 at which the print sheet passes the downstream drive end position of the belt driver 250, based on the print conveyance speed Vg and the size of the print sheet obtained by the print condition setter 310. Note that the speeds of the first acceleration conveyance driver 260 and the second acceleration conveyance driver 261 are set to the print conveyance speed Vg before the time point t11. Moreover, the speeds of the third acceleration conveyance driver 263, the constant speed conveyance driver 265, and the sheet discharge conveyance driver 270 (in the case of discharging the print sheet) are set to the circulation conveyance speed Vr before the time point t11.

Then, at the time point t12 at which the print sheet passes the downstream drive end position of the belt driver 250, the drive controller 302 starts the acceleration of the first acceleration conveyance driver 260 and the second acceleration conveyance driver 261 to accelerate the print sheet from the print conveyance speed Vg to the circulation conveyance speed Vr. Thus, no pull-out of the print sheet conveyed by the belt driver 250 occurs and therefore no slipping occurs. Moreover, the print sheet is already conveyed at the circulation conveyance speed Vr when reaching the constant speed conveyance driver 265. Accordingly, the pull-out of the print sheet by the constant speed conveyance driver 265 can be prevented. Hence, it is possible to prevent a degradation in print quality due to retransfer of the inks to the sheet and conveyance failure caused by wear of the belt.

Then, when the sheet sensor 259 detects the trailing edge of the print sheet at a time point t14, the drive controller 302 estimates a time point t15 at which the print sheet passes the first acceleration conveyance driver 260 and a time point t16 at which the print sheet passes the second acceleration conveyance driver 261, based on the circulation conveyance speed Vr and the size of the print sheet obtained by the print condition setter 310.

Then, the drive controller 302 starts the deceleration of the first acceleration conveyance driver 260 at the time point t15 at which the print sheet passes the first acceleration conveyance driver 260, and starts the deceleration of the second acceleration conveyance driver 261 at the time point t16 at which the print sheet passes the second acceleration conveyance driver 261.

Meanwhile, as illustrated in FIG. 4C, when the size of the print sheet obtained by the print condition setter 310 is the long size, that is, when the size of the print sheet in the conveyance route direction is longer than the second length and equal to or shorter than a third length of the conveyance route from the downstream drive end position of the belt driver 250 to the constant speed conveyance driver 265, the drive controller 302 starts the acceleration of the first acceleration conveyance driver 260, the second acceleration conveyance driver 261, and the third acceleration conveyance driver 263, upon determining that the print sheet has passed the downstream drive end position of the belt driver 250 based on the result of the print sheet detection by the sheet sensor 259, and accelerates the print sheet from the print conveyance speed Vg to the circulation conveyance speed Vr.

The print sheet is thereby accelerated by using all of the first acceleration conveyance driver 260, the second acceleration conveyance driver 261, and the third acceleration conveyance driver 263 also when the size of the print sheet is long. Accordingly, the print sheet can be surely accelerated to the circulation conveyance speed Vr.

Figure 7:
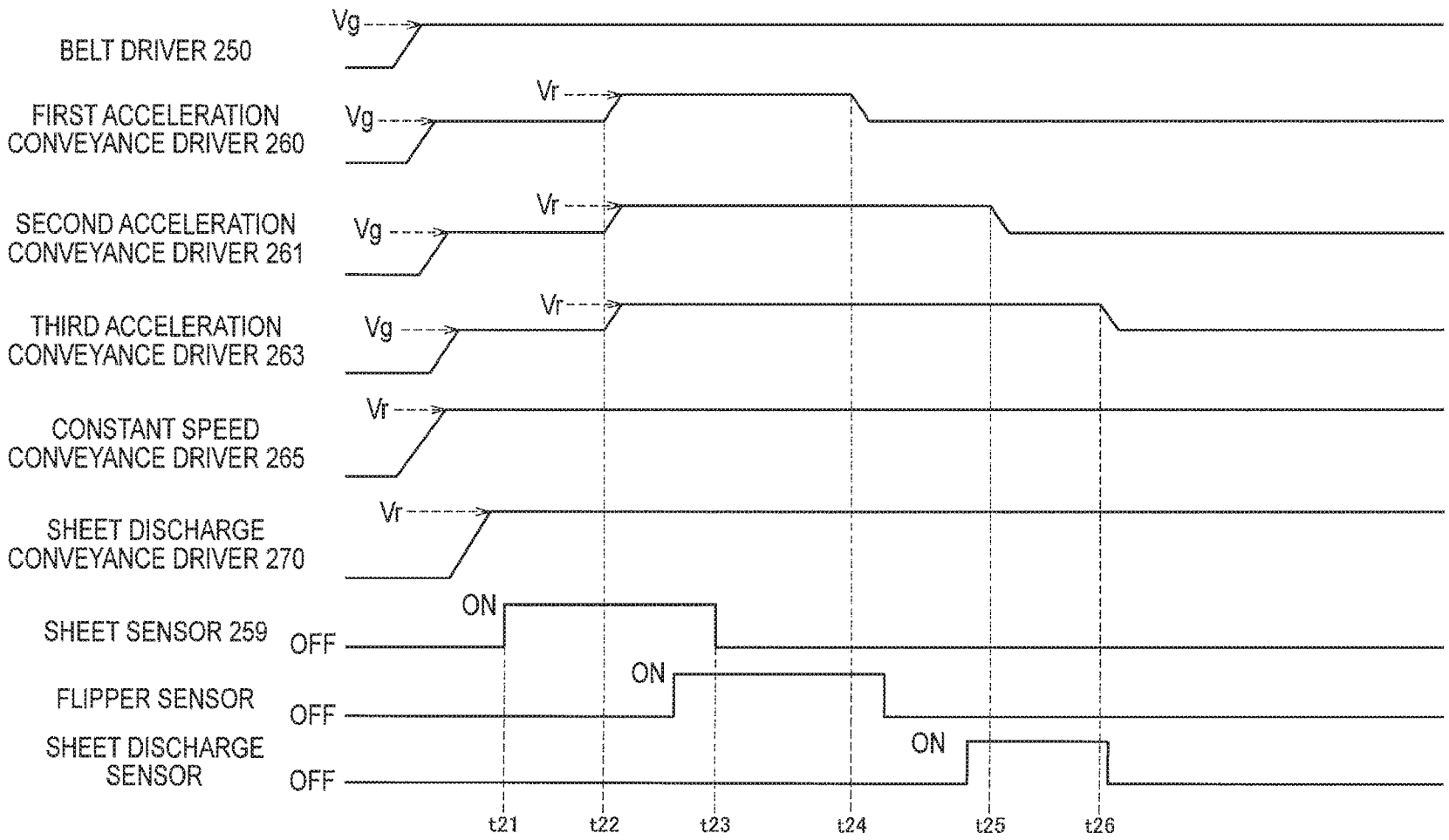
FIG. 7 is a timing chart illustrating timings in the acceleration conveyance performed when the long-size print sheet is conveyed.

FIG. 7 is a timing chart illustrating timings in the acceleration conveyance performed when the long-size print sheet is conveyed.

As illustrated in FIG. 7, when the sheet sensor 259 detects the leading edge of the print sheet at a time point t21, the drive controller 302 estimates a time point t22 at which the print sheet passes the downstream drive end position of the belt driver 250, based on the print conveyance speed Vg and the size of the print sheet obtained by the print condition setter 310. Note that the speeds of the first acceleration conveyance driver 260, the second acceleration conveyance driver 261, and the third acceleration conveyance driver 263 are set to the print conveyance speed Vg before the time point t21. Moreover, the speeds of the constant speed conveyance driver 265 and the sheet discharge conveyance driver 270 (in the case of discharging the print sheet) are set to the circulation conveyance speed Vr before the time point t21.

Then, at the time point t22 at which the print sheet passes the downstream drive end position of the belt driver 250, the drive controller 302 starts the acceleration of the first acceleration conveyance driver 260, the second acceleration conveyance driver 261, and the third acceleration conveyance driver 263 to accelerate the print sheet from the print conveyance speed Vg to the circulation conveyance speed Vr. Thus, no pull-out of the print sheet conveyed by the belt driver 250 occurs and therefore no slipping occurs. Moreover, the print sheet is already conveyed at the circulation conveyance speed Vr when reaching the constant speed conveyance driver 265. Accordingly, the pull-out of the print sheet by the constant speed conveyance driver 265 can be prevented. Hence, it is possible to prevent a degradation in print quality due to retransfer of the inks to the sheet and conveyance failure caused by wear of the belt.

Then, when the sheet sensor 259 detects the trailing edge of the print sheet at a time point t23, the drive controller 302 estimates a time point t24 at which the print sheet passes the first acceleration conveyance driver 260, a time point t25 at which the print sheet passes the second acceleration conveyance driver 261, and a time point t26 at which the print sheet passes the third acceleration conveyance driver 263, based on the circulation conveyance speed Vr and the size of the print sheet obtained by the print condition setter 310.

Then, the drive controller 302 starts the deceleration of the first acceleration conveyance driver 260 at the time point t24 at which the print sheet passes the first acceleration conveyance driver 260, starts the deceleration of the second acceleration conveyance driver 261 at the time point t25 at which the print sheet passes the second acceleration conveyance driver 261, and starts the deceleration of the third acceleration conveyance driver 263 at the time point t26 at which the print sheet passes the third acceleration conveyance driver 263.

As described above, the drive controller 302 controls the first acceleration conveyance driver 260, the second acceleration conveyance driver 261, and the third acceleration conveyance driver 263 such that at least the timing at which the acceleration of the print sheet is started is changed depending on the size of the conveyed print sheet in the conveyance route direction.

As described above, the first acceleration conveyance driver 260, the second acceleration conveyance driver 261, and the third acceleration conveyance driver 263 start the acceleration after the recording region trailing end of the print sheet passes the head unit 110, and convey the print sheet while accelerating the print sheet such that the speed thereof increases to the circulation conveyance speed Vr not later than when the leading edge of the print sheet reaches the constant speed conveyance driver 265. Moreover, the drive controller 302 controls the first acceleration conveyance driver 260, the second acceleration conveyance driver 261, and the third acceleration conveyance driver 263 such that at least the timing at which the acceleration of the print sheet is started is changed depending on the size of the conveyed print sheet in the conveyance route direction. Accordingly, it is possible to prevent the pull-out by the constant speed conveyance driver 265 which always conveys the print sheet at the constant speed of the circulation conveyance speed Vr. This can prevent retransfer of the inks to the sheet caused by the pull-out and conveyance failure caused by wear of the conveyance rollers in the conveyance drivers and, as a result, prevent a degradation in print quality.

Moreover, since the pull-out of the print sheet can be prevented, an impact noise in the pull-out can be prevented from occurring.

Furthermore, preventing the pull-out of the print sheet reduces slipping, and the possibility of the print sheet being jammed can be thereby reduced. Accordingly, it is possible to minimize the sheet interval between the conveyed print sheets and thereby improve the productivity.

Moreover, in a configuration in which the print sheet is pulled out, a one-way clutch needs to be provided in a conveyance driver from which the print sheet is pulled out to prevent failure. However, in the embodiment, since the pull-out of the print sheet can be prevented, there is no need to provide the one-way clutch in any of the conveyance drivers. Thus, the manufacturing cost can be reduced by an amount corresponding to the cost of the one-way clutch.

Note that, as described above, in the duplex printing in which printing is performed on both sides of the print sheet, the print sheet is pulled into the switchback route SR, turned over with respect to the conveyance route, subjected to printing on the back side in the same manner as that for the front side, and then guided to the sheet discharge opening 140 to be discharged.

In view of this, in the duplex printing, the timing at which the acceleration of the print sheet is started may be changed such that the acceleration is started after the recording region trailing end on the front surface subjected to printing and being in contact with the conveyor belt 160 passes the conveyor belt 160, to prevent the image printed on the front surface from being retransferred to the conveyor belt 160 in the printing of the back side.

Modified Example

In the embodiment, when the size of the print sheet is the short size, the drive controller 302 starts the acceleration of only the first acceleration conveyance driver 260, upon determining that the print sheet has passed the downstream drive end position of the belt driver 250 based on the result of the print sheet detection by the sheet sensor 259, and accelerates the print sheet from the print conveyance speed Vg to the circulation conveyance speed Vr. When the size of the print sheet is the middle-size, the drive controller 302 starts the acceleration of the first acceleration conveyance driver 260 and the second acceleration conveyance driver 261, upon determining that the print sheet has passed the downstream drive end position of the belt driver 250 based on the result of the print sheet detection by the sheet sensor 259, and accelerates the print sheet from the print conveyance speed Vg to the circulation conveyance speed Vr. When the size of the print sheet is the long size, the drive controller 302 starts the acceleration of the first acceleration conveyance driver 260, the second acceleration conveyance driver 261, and the third acceleration conveyance driver 263, upon determining that the print sheet has passed the downstream drive end position of the belt driver 250 based on the result of the print sheet detection by the sheet sensor 259, and accelerates the print sheet from the print conveyance speed Vg to the circulation conveyance speed Vr.

In the embodiment, the short size is described to be equal to the length of the conveyance route from the downstream drive end position of the belt driver 250 to the second acceleration conveyance driver 261 in the conveyance route direction, the middle size is described to be equal to the length of the conveyance route from the downstream drive end position of the belt driver 250 to the third acceleration conveyance driver 263 in the conveyance route direction, and the long size is described to be equal to the length of the conveyance route from the downstream drive end position of the belt driver 250 to the constant speed conveyance driver 265 in the conveyance route direction. However, the sizes are not limited to these. For example, the short size, the middle size, and the long size may be equal to lengths of the conveyance route from the downstream end of the head unit 110 to the respective drivers.

Specifically, in the modified example of the embodiment, when the size of the print sheet in the conveyance route direction (conveyance direction) is equal to or shorter than a fourth length of the conveyance route from the downstream end of the head unit 110 to the second acceleration conveyance driver 261, the drive controller 302 starts the acceleration of only the first acceleration conveyance driver 260 upon determining that the print sheet has passed the downstream end of the head unit 110 based on the result of the print sheet detection by the sheet sensor 259, and accelerates the print sheet from the print conveyance speed Vg to the circulation conveyance speed Vr. When the size of the print sheet in the conveyance route direction (conveyance direction) is longer than the fourth length and equal to or shorter than a fifth length of the conveyance route from the downstream end of the head unit 110 to the third acceleration conveyance driver 263, the drive controller 302 starts the acceleration of the first acceleration conveyance driver 260 and the second acceleration conveyance driver 261, upon determining that the print sheet has passed the downstream end of the head unit 110 based on the result of the print sheet detection by the sheet sensor 259, and accelerates the print sheet from the print conveyance speed Vg to the circulation conveyance speed Vr. When the size of the print sheet in the conveyance route direction (conveyance direction) is longer than the fifth length and equal to or shorter than a sixth length of the conveyance route from the downstream end of the head unit 110 to the constant speed conveyance driver 265, the drive controller 302 starts the acceleration of the first acceleration conveyance driver 260, the second acceleration conveyance driver 261, and the third acceleration conveyance driver 263, upon determining that the print sheet has passed the downstream end of the head unit 110 based on the result of the print sheet detection by the sheet sensor 259, and accelerates the print sheet from the print conveyance speed Vg to the circulation conveyance speed Vr.

The acceleration of the print sheet thereby starts when the print sheet moves past the head unit 110. Thus, the print sheet can reach the circulation conveyance speed Vr sooner and the productivity can be improved.

In the embodiment described above, the description is given of the conveyance control performed after the first printing on one side in the duplex printing in which the print sheet is circulated and conveyed. However, the conveyance control may be applied to conveyance performed after the printing on the other side. In this case, the circulation conveyance speed Vr can be considered to be a sheet discharge conveyance speed (second conveyance speed) Vr for discharging the print sheet in the sheet discharge conveyance driver 270. Moreover, the conveyance control in the embodiment can be applied also to the simplex printing of the print sheet. In this case, the circulation conveyance speed Vr can be considered to be a sheet discharge conveyance speed (second conveyance speed) Vr for discharging the print sheet in the sheet discharge conveyance driver 270. Although the circulation conveyance speed and the sheet discharge conveyance speed are denoted by the same reference sign, the values of the respective speeds may vary. Note that the sheet discharge conveyance speed Vr is also set to be a speed equal to or higher than the print conveyance speed Vg to avoid collision between the print sheets in the circulation system conveyance route CR.

Moreover, in the aforementioned embodiment, the printer 100 includes three mechanisms for accelerating the print sheet, that is the first acceleration conveyance driver 260, the second acceleration conveyance driver 261, and the third acceleration conveyance driver 263. However, the configuration of the printer 100 is not limited to this. Only one mechanism for accelerating the print sheet may be provided or four or more of such mechanisms may be provided.

In the aforementioned embodiment, the line color printer of the inkjet method which performs printing in units of lines is described as an example of the printer 100. However, in the present invention, the printer 100 is not limited to this. The present invention can be similarly applied to image forming apparatuses such as a stencil printer and a laser printer because these printers perform printing on the print sheet.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printer comprising:

a conveyance route;

an image former configured to form an image on a recording medium being conveyed along the conveyance route;

a first conveyor configured to convey the recording medium during image formation by the image former along the conveyance route at a first conveyance speed based on a print condition of the image formation by the image former;

a second conveyor configured to convey the recording medium along the conveyance route at a second conveyance speed higher than the first conveyance speed;

a third conveyor arranged between the first conveyor and the second conveyor on the conveyance route and configured to convey the recording medium along the conveyance route, the third conveyor being configured to, from operating at the first conveyance speed, start acceleration of the recording medium after a recording region trailing end of the recording medium passes the image former and accelerate the recording medium such that a speed of the recording medium increases to the second conveyance speed not later than a time point when a leading edge of the recording medium reaches the second conveyor, the third conveyor including:

a first acceleration conveyance driver;

a second acceleration conveyance driver located downstream of the first acceleration conveyance driver on the conveyance route; and a third acceleration conveyance driver located downstream of the second acceleration conveyance driver on the conveyance route; and a drive controller configured to control a timing at which each of the first, second, and third acceleration conveyance drivers of the third conveyor is driven to start the acceleration of the recording medium.

2. The printer according to claim 1, wherein the first conveyor comprises a conveyor belt, the second conveyor comprises at least one of a roller or a conveyor belt, and each of the first, second, and third acceleration conveyance drivers comprises at least one of a roller or a conveyor belt.

3. The printer according to claim 1, wherein the third conveyor is configured to, from the operating at the first conveyance speed, start the acceleration of the recording medium immediately after the recording region trailing end of the recording medium passes the image former and accelerate the recording medium.

4. The printer according to claim 1, wherein the third conveyor is a first driver to convey the recording medium after the first conveyor in the conveyance route.

5. A printer comprising:

a conveyance route;

an image former configured to form an image on a recording medium being conveyed along the conveyance route;

a first conveyor configured to convey the recording medium during image formation by the image former along the conveyance route at a first conveyance speed based on a print condition of the image formation by the image former;

a second conveyor configured to convey the recording medium along the conveyance route at a second conveyance speed higher than the first conveyance speed;

a third conveyor arranged between the first conveyor and the second conveyor on the conveyance route and configured to convey the recording medium along the conveyance route, the third conveyor being configured to start acceleration of the recording medium after a recording region trailing end of the recording medium passes the image former and accelerate the recording medium such that a speed of the recording medium increases to the second conveyance speed not later than a time point when a leading edge of the recording medium reaches the second conveyor; and a drive controller configured to control a timing at which the third conveyor starts the acceleration; and a detector arranged between the first conveyor and the third conveyor on the conveyance route and configured to detect the recording medium being conveyed, wherein the third conveyor comprises:

a first acceleration conveyance driver;

a second acceleration conveyance driver located downstream of the first acceleration conveyance driver on the conveyance route; and a third acceleration conveyance driver located downstream of the second acceleration conveyance driver on the conveyance route, and the drive controller is configured to:

for the recording medium of a size in a conveyance direction being equal to or shorter than a first length of the conveyance route from a downstream drive end position of the first conveyor to the second acceleration conveyance driver, drive the first acceleration conveyance driver to start the acceleration of the recording medium upon determining that the recording medium has passed the downstream drive end position of the first conveyor based on a detection result of the detector and to accelerate the recording medium to the second conveyance speed;

for the recording medium of the size in the conveyance direction being longer than the first length and equal to or shorter than a second length of the conveyance route from the downstream drive end position of the first conveyor to the third acceleration conveyance driver, drive the first acceleration conveyance driver and the second acceleration conveyance driver to start the acceleration of the recording medium upon determining that the recording medium has passed the downstream drive end position of the first conveyor based on the detection result of the detector and to accelerate the recording medium to the second conveyance speed; and for the recording medium of the size in the conveyance direction being longer than the second length and equal to or shorter than a third length of the conveyance route from the downstream drive end position of the first conveyor to the second conveyor, drive the first acceleration conveyance driver, the second acceleration conveyance driver, and the third acceleration conveyance driver to start the acceleration of the recording medium upon determining that the recording medium has passed the downstream drive end position of the first conveyor based on the detection result of the detector and to accelerate the recording medium to the second conveyance speed.

6. The printer according to claim 5, wherein the first conveyor comprises a conveyor belt, the second conveyor comprises at least one of a roller or a conveyor belt, and each of the first, second, and third acceleration conveyance drivers comprises at least one of a roller or a conveyor belt.

7. A printer comprising:

a conveyance route;

an image former configured to form an image on a recording medium being conveyed along the conveyance route;

a first conveyor configured to convey the recording medium during image formation by the image former along the conveyance route at a first conveyance speed based on a print condition of the image formation by the image former;

a second conveyor configured to convey the recording medium along the conveyance route at a second conveyance speed higher than the first conveyance speed;

a third conveyor arranged between the first conveyor and the second conveyor on the conveyance route and configured to convey the recording medium along the conveyance route, the third conveyor being configured to start acceleration of the recording medium after a recording region trailing end of the recording medium passes the image former and accelerate the recording medium such that a speed of the recording medium increases to the second conveyance speed not later than a time point when a leading edge of the recording medium reaches the second conveyor; and a drive controller configured to control a timing at which the third conveyor starts the acceleration; and a detector arranged between the first conveyor and the third conveyor on the conveyance route and configured to detect the conveyed recording medium, wherein the third conveyor comprises:

a first acceleration conveyance driver;

a second acceleration conveyance driver located downstream of the first acceleration conveyance driver on the conveyance route; and a third acceleration conveyance driver located downstream of the second acceleration conveyance driver on the conveyance route, and the drive controller is configured to:

for the recording medium of a size in a conveyance direction being equal to or shorter than a fourth length of the conveyance route from a downstream end of the image former to the second acceleration conveyance driver, drive the first acceleration conveyance driver to start the acceleration of the recording medium upon determining that the recording medium has passed the downstream end of the image former based on a detection result of the detector and to accelerate the recording medium to the second conveyance speed;

for the recording medium of the size in the conveyance direction being longer than the fourth length and equal to or shorter than a fifth length of the conveyance route from the downstream end of the image former to the third acceleration conveyance driver, drive the first acceleration conveyance driver and the second acceleration conveyance driver to start the acceleration of the recording medium upon determining that the recording medium has passed the downstream end of the image former based on the detection result of the detector and to accelerate the recording medium to the second conveyance speed; and for the recording medium of the size in the conveyance direction being longer than the fifth length and equal to or shorter than a sixth length of the conveyance route from the downstream end of the image former to the second conveyor, drive the first acceleration conveyance driver, the second acceleration conveyance driver, and the third acceleration conveyance driver to start the acceleration of the recording medium upon determining that the recording medium has passed the downstream end of the image former based on the detection result of the detector and to accelerate the recording medium to the second conveyance speed.

8. The printer according to claim 7, wherein the first conveyor comprises a conveyor belt, the second conveyor comprises at least one of a roller or a conveyor belt, and each of the first, second, and third acceleration conveyance drivers comprises at least one of a roller or a conveyor belt.

* * * * *